US006023814A

United States Patent [19]

Imamura

[11] Patent Number: 6,023,814

[45] Date of Patent: Feb. 15, 2000

[54] VACUUM CLEANER

[76] Inventor: Nobuo Imamura, c/o Yashima Electric Co., Ltd. of 1 Ishihara, Nogami, Kissho-in, Minami-ku, Kyoto-shi, Kyoto 601, Japan

[21] Appl. No.: 08/929,681

[22] Filed: Sep. 15, 1997

[51] Int. Cl.[7] ..... A47L 9/28

[52] U.S. Cl. ..... 15/339; 15/319

[58] Field of Search ..... 15/319, 339

[56] References Cited

U.S. PATENT DOCUMENTS

| | | | |
|---|---|---|---|
| 5,323,483 | 6/1994 | Baeg . | |
| 5,404,612 | 4/1995 | Ishikawa | 15/339 |
| 5,542,146 | 8/1996 | Hoekstra et al. | 15/339 |
| 5,608,944 | 3/1997 | Gordon | 15/339 |
| 5,815,884 | 10/1998 | Imamura et al. | 15/339 |
| 5,881,430 | 3/1999 | Diessen et al. | 15/339 |

FOREIGN PATENT DOCUMENTS

| | | |
|---|---|---|
| A-0 372 903 | 6/1990 | European Pat. Off. . |
| A-0 443 845 | 8/1991 | European Pat. Off. . |
| A-0584 743 | 3/1994 | European Pat. Off. . |
| 7051206 | 2/1995 | Japan . |
| 9149871 | 6/1997 | Japan . |

*Primary Examiner*—Terrence R. Till
*Attorney, Agent, or Firm*—Smith, Gambrell & Russell, LLP; Beveridge, DeGrandi, Weilacher & Young Intellectual Property Group

[57] ABSTRACT

A vacuum cleaner includes a dust sensor of the light emitting and light receiving type, which sensor detects the quantity of dust which is sucked during a cleaning operation. The vacuum cleaner also includes a sensitivity correction section which compensates for lowering of the dust detection sensitivity due to soiling of the dust sensor, a limit detection section which detects a condition in which the compensation of dust detection sensitivity by the sensitivity correction section reaches a limit value, and an information section which informs the vacuum cleaner user of the condition in which correction of the dust detection sensitivity by the sensitivity correction section has reached its limit value.

5 Claims, 4 Drawing Sheets

VACUUM CLEANER

BACKGROUND OF THE INVENTION

The present invention relates to a vacuum cleaner. More particularly, the present invention relates to a vacuum cleaner having a dust sensor which detects a quantity of dust included in the air which is sucked in by the vacuum cleaner. According to the present invention, when the dust sensor becomes too dirty to operate properly, an indicator is activated to alert the user to clean the dust sensor.

RELATED ARTS

In the past, a vacuum cleaner having a dust sensor has been proposed. A dust sensor of a light emitting and receiving type using an infrared light beam or the like is now popularly employed as the dust sensor for vacuum cleaners.

A dust sensor of a light emitting and receiving type includes a light emitting device (for example, an infrared light emitting diode) for emitting an infrared light beam or the like and a light receiving device (for example, a phototransistor) for receiving the light which is emitted from the light emitting device. And, the light emitting device and the light receiving device are disposed at predetermined positions of a dust suction passage member. The light emitting device and the light receiving device are disposed at predetermined relative positions to one another. Window members having high light transmissivity are disposed with respect to the light emitting device and the light receiving device, so as to prevent variation in the optical characteristics (e.g. light emitting characteristics, light receiving characteristics, the direction of the optical axis and the like) from occurring, which variation is caused by the collision and/or adhesion of dust to surfaces of the light emitting device and the light receiving device. Relative positions of the light emitting device and the light receiving device may be determined so that the light emitted from the light emitting device is directly received by the light receiving device. Also, relative positions of the light emitting device and the light receiving device may be determined so that the light receiving device receives a partial amount of light which is reflected by dust particles and/or a partial amount of light which is scattered by dust particles from the total light emitted by the light emitting device.

When air in which dust particles are included is sucked through the dust suction passage member, and when an intensity of infrared light emitted from the light emitting device is determined to be constant, the intensity of infrared light received by the light receiving device is determined by the quantity of dust which is included within a suction air. Specifically, when the relative positions of the light emitting device and the light receiving device are determined so that the infrared light emitted from the light emitting device is directly received by the light receiving device, the intensity of infrared light which is received by the light receiving device decreases following an increase in the quantity of dust particles. On the contrary, when the relative positions of the light emitting device and the light receiving device are determined so that the light receiving device receives a partial amount of light which is reflected by dust particles and/or scattered by dust particles from the total amount of light emitted by the light emitting device, the intensity of the light which is received by the light receiving device increases following an increase in the quantity of dust particles.

Therefore, the quantity of dust particles included within the suction air is detected by determining the intensity of light received by the light receiving device based upon an electrical signal output from the light receiving device.

When the dust sensor having the above arrangement is employed, it is possible to prevent the optical characteristics of the light emitting device and the light receiving device themselves from varying. But, fine particles among the dust which is included within the suction air adhere to the window members covering the light emitting and receiving devices. The total quantity of fine particles which adhere to the window members increases depending upon an increase of the working time of the vacuum cleaner, the quantity of dust within a suction air and the like. As a result, the disadvantage arises in that the dust detection sensitivity of the dust sensor is lowered, because the light transmissivity of each window member is lowered depending upon the total quantity of fine particles adhering to the window members.

To prevent the above disadvantage from occurring, automated sensitivity correction circuitry or the like has been proposed, which compensates for the reduction in light transmissivity of each window member by increasing the light emitting energy of the light emitting device when the light transmissivity of each window member is lowered.

When the automated sensitivity correction circuitry is employed, breakdown of the light emitting device should be prevented from occurring. Therefore, the "turning on" current value of the light emitting device inevitably has an upper limit value, above which it is impossible for the sensitivity of the dust sensor to be corrected by increasing the turning on current over the upper limit value.

A vacuum cleaner user cannot know when the sensitivity correction by the automated sensitivity correction circuitry reaches its limit (i.e. when the turning on current value of the light emitting device reaches the upper limit value). Therefore, even when the automated sensitivity correction circuitry operates and the turning on current value of the light emitting device reaches the upper limit value, the vacuum cleaner user cannot know that the vacuum cleaner is in such condition. A disadvantage arises in that the vacuum cleaner user keeps using the vacuum cleaner as it is.

It is an object of the present invention to detect a condition in which sensitivity correction by automated sensitivity correction circuitry or the like reaches its limit so that further sensitivity correction becomes impossible.

It is another object of the present invention to inform the vacuum cleaner user of such a condition that further sensitivity correction becomes impossible.

SUMMARY OF THE INVENTION

A vacuum cleaner according to the present invention includes a vacuum cleaner body, a suction fan provided at a predetermined position in the vacuum cleaner body, a suction passage means for sucking in air with dust during a cleaning operation, and for guiding the dust and the air to the vacuum cleaner body, a dust sensor of a light emitting and receiving type which is provided at a predetermined position along the suction passage means, an automated sensitivity correction means, a limit detection means for detecting a condition in which correction of the dust detection sensitivity by the automated sensitivity correction means reaches its limit, and information means for responding to detection of the limit condition by the limit detection means in which correction of the dust detection sensitivity by the automated sensitivity correction means reaches its limit, and for informing the user of the limit condition in which correction of the dust detection sensitivity by the automated sensitivity correction means reaches its limit.

When the vacuum cleaner having the above arrangement is employed, the quantity of dust within the sucked air is detected by the dust sensor during cleaning which is performed by sucking in air with dust through the suction passage means by operating the suction fan. When fine particles of dust adhere to the window members of the dust sensor so that the dust detection sensitivity of the dust sensor is lowered, the automated sensitivity correction means increases the intensity of the light emitted from the light emitting device included in the dust sensor, so that correction of the dust detection sensitivity is realized.

When the intensity of the light emitted from the light emitting device reaches its upper limit value making the further correction of the dust detection sensitivity by the automated sensitivity correction means impossible, the limit detection means detects this upper limit condition and the informing means informs the vacuum cleaner user of the upper limit condition in which correction of the dust detection sensitivity by the automated sensitivity correction means reaches its limit value.

Therefore, a vacuum cleaner user is aware of the condition in which so many fine particles of dust adhere to the window members of the dust sensor that further correction of the dust detection sensitivity becomes impossible. The vacuum cleaner user can then clean the window members of the dust sensor based upon the above knowledge, so that the dust detection sensitivity of the dust sensor is restored to its initial dust detection sensitivity. As a result, the disadvantage is prevented from occurring where a vacuum cleaner user is unaware of a condition in which the dust sensor for the vacuum cleaner cannot operate properly and the vacuum cleaner user continues cleaning with the vacuum cleaner.

PREFERRED EMBODIMENTS OF THE PRESENT INVENTION

Figure 1:
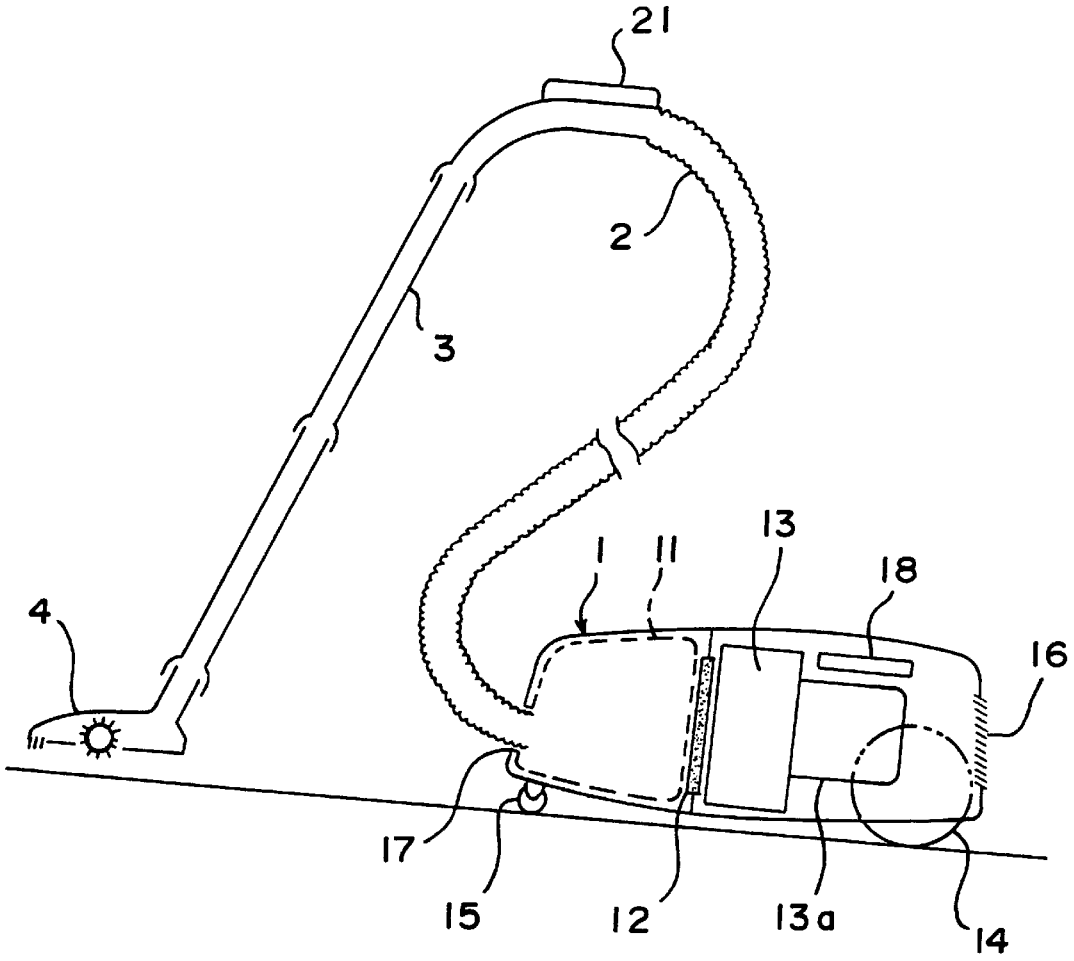
FIG. 1 is a side view schematically illustrating an overall arrangement of a vacuum cleaner according to one embodiment of the invention.

A vacuum cleaner illustrated in FIG. 1 includes a vacuum cleaner body 1, a suction hose 2, an extension pipe 3 (a pipe for extending the reach of the hose 2) and a floor nozzle 4.

The vacuum cleaner body 1 includes a connection section 17 at a predetermined position at one end for connecting the suction hose 2, and an exhaust section 16 at a predetermined position at another end for blowing air therefrom. Contained within the vacuum cleaner body 1 is a dust bag 11, a partitioning wall member 12 which permits air to pass therethrough, and a suction fan 13 which is driven by a motor 13*a*. The dust bag 11, the partitioning wall member 12 and the suction fan 13 are disposed in this order from the connection section 17. Further, the vacuum cleaner body 1 includes a pair of wheels 14 and a caster 15 along its bottom for allowing the vacuum cleaner body 1 to freely roll. Furthermore, the vacuum cleaner body 1 includes therein a control section 18 at a predetermined position, for controlling the motor 13*a* and the like.

Figure 2:
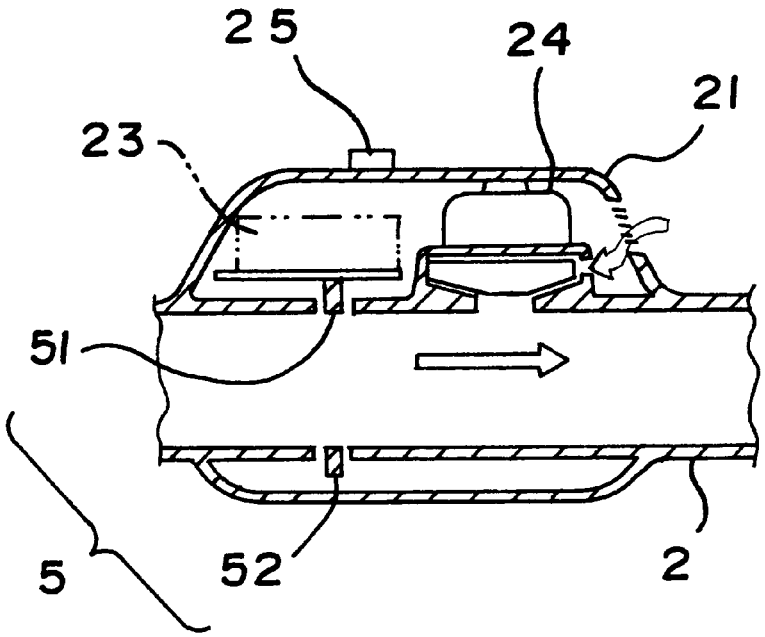
FIG. 2 is a cross sectional view schematically illustrating the arrangement of a dust sensor according to the embodiment of the invention illustrated in FIG. 1.

The suction hose 2 is a hose having a bellows shape to permit the hose to be freely bent in any direction. The suction hose 2 is connected to the connection section 17 of the vacuum cleaner body 1 in a removable manner. Electric wires (not shown) for sending and receiving electric signals used to control the vacuum cleaner are provided within the suction hose 2. A control section 21 is provided at a leading edge portion of the suction hose 2. The control section 21 includes, as is illustrated in FIG. 2, switches (not shown) for instructing the operation of the vacuum cleaner, and a printed circuit board 23 on which a control circuitry is mounted. The control section 21 also includes a turbine generator 24, which is rotated by air sucked through a vent of the control section 21 to an interior of the suction hose 2 so as to generate a D.C. voltage when the vacuum cleaner operates, and a display section 25 for informing the vacuum cleaner user of various information. Further, the control section 21 contains a dust sensor 5, which consists of a light emitting device 51 and a light receiving device 52. The light emitting device (which may be, for example, an infrared light emitting diode) 51 and the light receiving device (which may be, for example, a phototransistor) 52 are each provided at an inner face of the suction hose 2 in a leading edge portion, so as to oppose one another across the suction hose 2.

Figure 3:
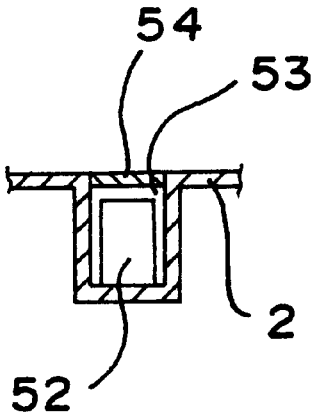
FIG. 3 is a cross sectional view schematically illustrating in greater detail the light receiving device more generally shown in FIG. 2.

As more specifically shown in FIG. 3, the light receiving device 52 is provided in the interior of a concave section 53 formed in a wall of the suction hose 2. A transparent window member 54 then is provided to cover the opening of the concave section 53. The light receiving device 52 is positioned so that the light receiving face of the light receiving device 52 faces toward window 54. The light emitting device 51 is arranged in the same manner as the light receiving device 52 on the opposite side of the hose 2, and therefore the illustration and description of the arrangement of the light emitting device 51 will be omitted. However, it should be noted that an arrangement may be employed in which window members 54 are not provided, and the light emitting device 51 and the light receiving device 52 are instead simply provided by themselves.

The floor nozzle 4 has a shape and an arrangement which are suitable for sucking dust from a floor or the like. The shape and the arrangement are widely known, and therefore a detailed description of the floor nozzle 4 will be omitted. The floor nozzle 4 can be connected directly to the leading edge portion of the suction hose 3, or the floor nozzle 4 also can be connected to the leading edge portion of the suction hose 3 by interposing the extension pipe 3. When the latter connection arrangement is employed, an operator may easily perform a cleaning operation in a standing posture.

Figure 4:
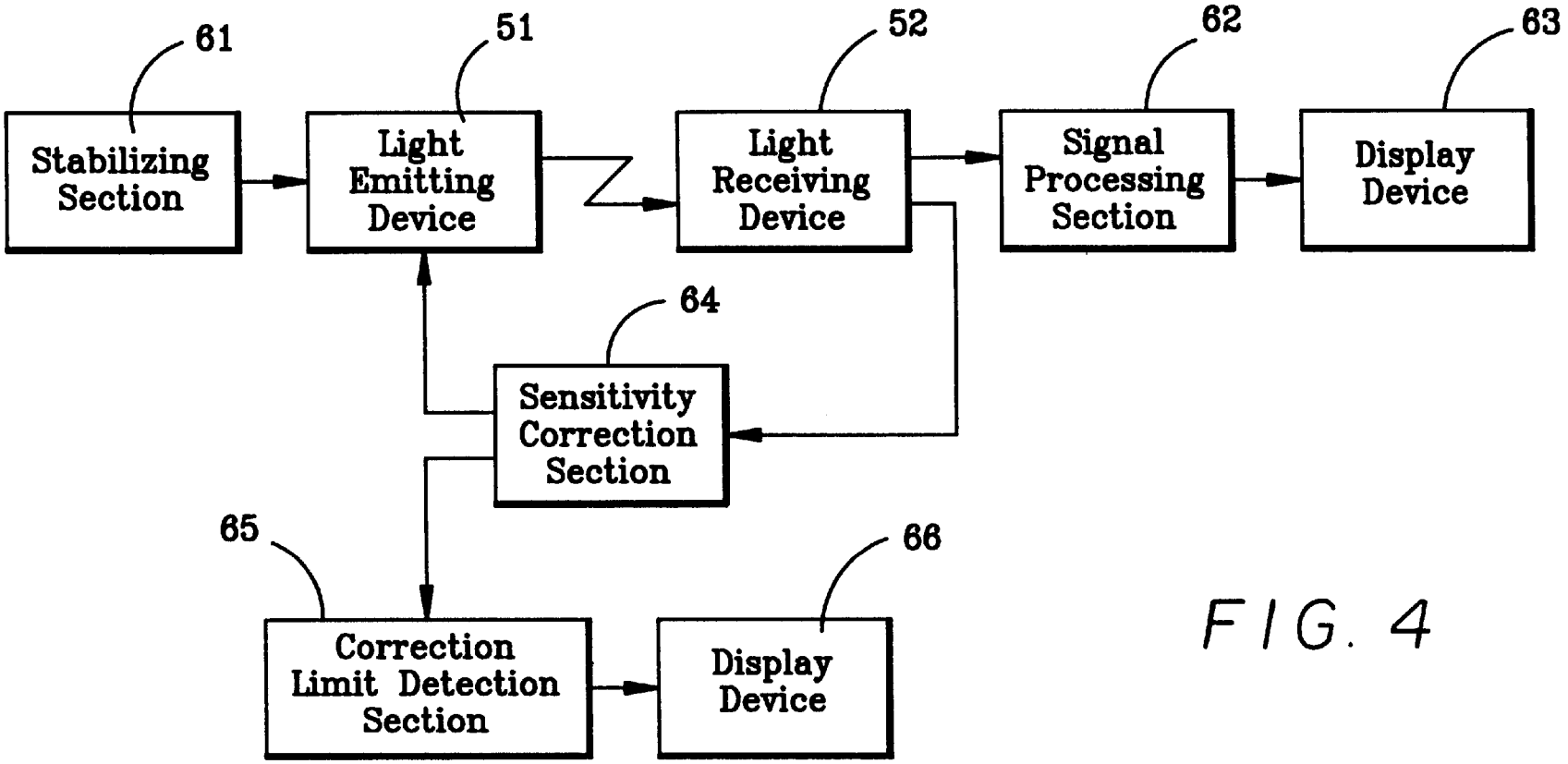
FIG. 4 is a block diagram illustrating an arrangement of the dust detection system of the vacuum cleaner.

FIG. 4 is a block diagram illustrating the dust detection system of the vacuum cleaner.

The dust detection system includes a stabilizing section 61 for stabilizing a D.C. voltage output from the turbine generator 24, the light emitting device 51 to which the stabilized D.C. voltage is applied, and the light receiving device 52, which receives at least a part of the radiated light from the light emitting device 51, and a signal processing section 62 for receiving the output signal from the light receiving device 52 and for generating a dust quantity detection signal in response. The dust detection system also includes a display device 63 which is driven by the dust quantity detection signal output from the signal processing section 62, a sensitivity correction section 64 for detecting variations in the output signal from the light receiving device 52 due to soiling of the window member 54 and for correcting the dust detection sensitivity of the dust sensor 5 by increasing the intensity of the light emitted from the light emitting device 51, a correction limit detection section 65 for detecting a limit condition of correction in dust detection sensitivity of the sensitivity correction section 64, and a display device 66 which is driven by a correction limit detection signal output from the correction limit detection section 65 in response to the detection of a limit condition.

It should be noted that it is possible to employ a D.C. power circuit, to receive, reduce and rectify A.C. power, battery, or other power source instead of the turbine generator 24. Further, it is possible that the display device 63 and the display device 66 are united together in a single unit to simplify their arrangement.

When the above arrangement is employed, the following operation is realized. When the window members 54 are not soiled at all, the light emitting device 51 radiates a light having a predetermined intensity, and the light receiving device 52 receives the light at an intensity which corresponds to the quantity of dust which is sucked with the air through the suction hose 2. The signal processing section 62 receives the output signal from the light receiving device 52 and generates a dust quantity detection signal in response. The display device 63 is then driven by the dust quantity detection signal so that the quantity of dust within the sucked air is visually displayed. Of course, the display device 66 is not driven at all in this situation. Therefore, the vacuum cleaner user knows that the visual display of the quantity of dust by the display device 63 is reliable.

After cleaning is performed using the vacuum cleaner, a portion of the fine particles within the dust adheres to the window members 54, so that the light transmissivity of each window member 54 decreases. The intensity of the light received by the light receiving device 52 thus is lowered, so that the output signal from the light receiving device 52 is varied (for example, is decreased). The sensitivity correction section 64 then operates to compensate for the variation in the output signal, so that the intensity of radiated light from the light emitting device 51 is increased. As a result, the quantity of dust within the sucked air is visually displayed in a similar manner as when the window members 54 are not soiled at all.

When soil of the window members 54 increases so much that correction of the dust detection sensitivity by the sensitivity correction section 64 reaches a limit (for example, when the driving current of the light emitting device 51 increases up to its maximum value), the correction limit detection section 65 detects this limit condition, and outputs a correction limit detection signal. The display device 66 then is driven by the correction limit detection signal. With the activation of the display device 66, the vacuum cleaner user knows that the visual display of the quantity of dust by the display device 63 is not reliable, and that the window members 54 should be cleaned. When the vacuum cleaner user cleans the window members 54 (using a cloth or the like) based upon the above knowledge, the dust sensor 5 is restored to its original operating condition.

Further, when an arrangement is employed in which window members 54 are not provided, lowering of the dust detection sensitivity due to soiling of the light emitting face of the light emitting device 51 and the light receiving face of the light receiving device 52 is corrected by the sensitivity correction section 64. When the limit condition is reached, the vacuum cleaner user responds to the display of a limit condition from the display device 66 by cleaning the light emitting face of the light emitting device 51 and the light receiving face of the light receiving device 52 (using a cloth or the like), so that the dust sensor 5 is restored to its original operating condition.

Figure 5:
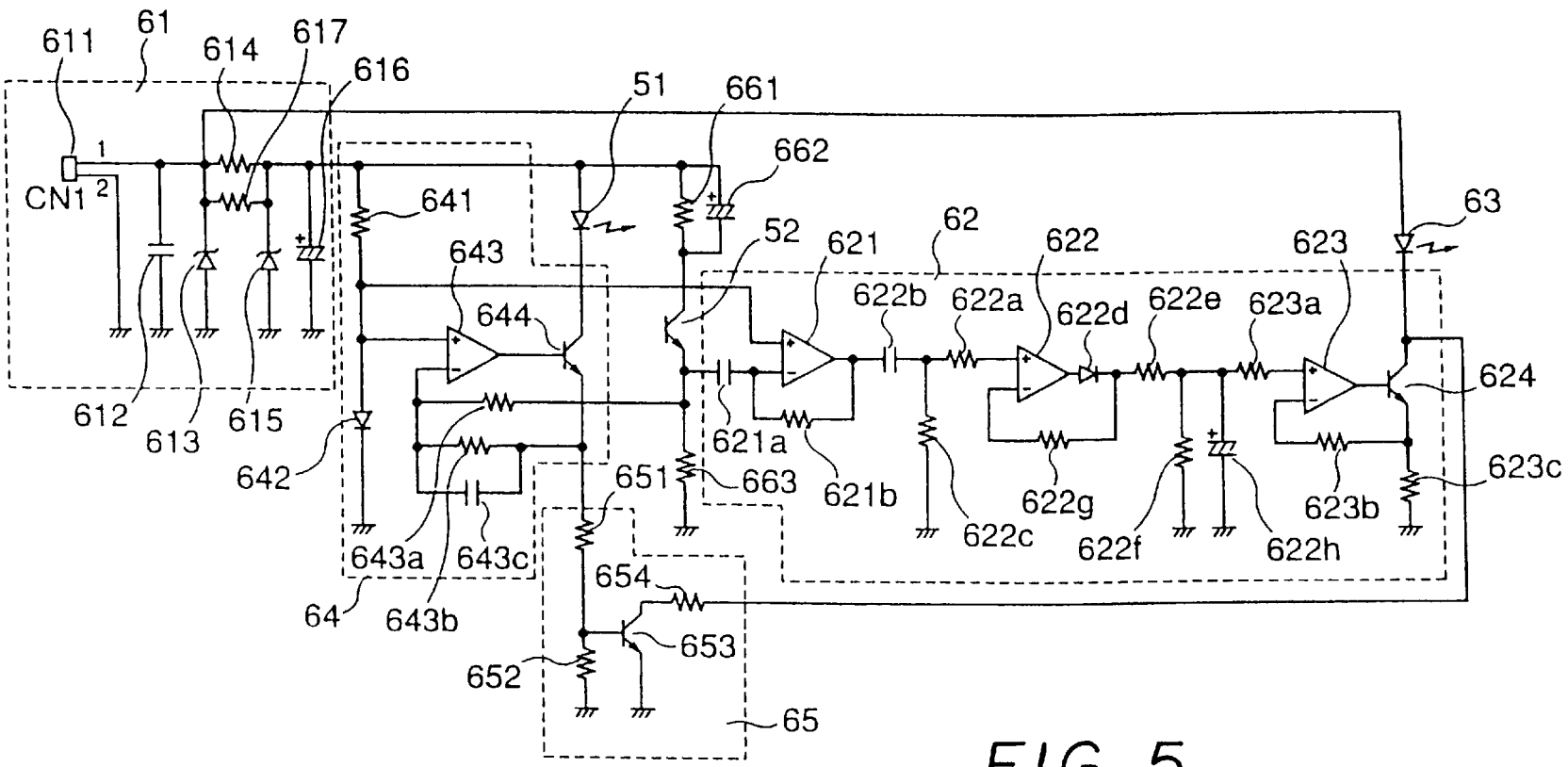
FIG. 5 is an electrical circuit diagram illustrating the dust sensor, the automated sensitivity correction circuitry, the correction limit detection circuitry and the informing circuitry.

FIG. 5 is an electrical circuitry diagram illustrating the dust sensor (i.e. the light emitting device 51 and the light receiving device 52), an automated sensitivity correction circuit, and a correction limit detection circuit. In this electrical circuitry diagram, each of the stabilizing section 61, the signal processing section 62, the sensitivity correction section 64 and the correction limit detection section 65 are separately enclosed with a dashed line. A display device 63 displays not only a quantity of suction dust but also a condition in which correction by the sensitivity correction section 64 reaches a limit.

The stabilizing section 61 includes a connector 611, which is connected to the output terminals of a D.C. power source such as a turbine generator, battery or the like, and a capacitor 612 which is connected between a positive voltage terminal and a negative voltage terminal of the connector 611 (e.g. an electrical ground). The stabilizing section 61 also includes a first zener diode 613 which is connected between the positive voltage terminal and the negative voltage terminal of the connector 611, a resistance 614 and a second zener diode 615 which are connected in series to one another between the positive voltage terminal and the negative voltage terminal of the connector 611, a capacitor 616 which is connected in parallel to the second zener diode 615, and a resistance 617 which is connected in parallel to the resistance 614. The resistance 617 may be omitted. The voltage between the terminals of the first zener diode 613 is output as a first driving voltage for driving the display device 63, while the voltage between the terminals of the capacitor 616 is output as a second driving voltage for driving the light emitting device 51, the light receiving device 52 and the sensitivity correction section 64.

A phototransistor is employed as the light emitting device 52. The collector terminal of the phototransistor 52 is connected to the positive voltage terminal of the capacitor 616 through a resistance 661 and a capacitor 662 which are connected in parallel to one another. The emitter terminal of the phototransistor 52 is connected to the negative voltage terminal of the capacitor 616 through a resistance 663.

The sensitivity correction section 64 includes a resistance 641, a diode 642, a comparator 643 and a transistor 644. The resistance 641 and the diode 642 are connected in series to one another between the positive voltage terminal and the negative voltage terminal of the capacitor 616, so that a standard voltage having a predetermined voltage value is generated at a connecting point of the resistance 641 and the diode 642. The comparator 643 then compares the emitter terminal voltage of the phototransistor 52 with the standard voltage having the predetermined voltage value, and outputs the difference in voltage between the emitter terminal voltage and the standard voltage as an output signal. The transistor 644 is controlled by the output signal of the comparator 643, so that the transistor 644 varies driving current of the light emitting diode which functions as the light emitting device 51. Further, a resistance 643*a* is connected between the reversed input terminal of the comparator 643 and the emitter terminal of the phototransistor 52. The non-reversed input terminal of the comparator 643 is connected to the connecting point of the resistance 641 and the diode 642. A resistance 643*b* and a capacitor 643*c* are connected in parallel to one another between the reversed input terminal of the comparator 643 and the emitter terminal of the transistor 644.

The signal processing section 62 includes a first operational amplifier 621, a second operational amplifier 622, a third operational amplifier 623 and a transistor 624. The first, second and third operational amplifiers 621, 622 and 623 amplify the difference voltage between the emitter terminal voltage of the phototransistor 52 and the standard voltage having the predetermined voltage value (which is determined based upon the resistance 641 and the diode 642), so that the intensity of the light emitted by the display device 63 is varied by controlling the transistor 624.

In the signal processing section 62, the non-reversed input terminal of the first operational amplifier 621 is connected to the connecting point of the resistance 641 and the diode 642, while the reversed input terminal of the first operational amplifier 621 is connected to the emitter terminal of the phototransistor 52 through a capacitor 621*a*. A resistance 621*b* is connected between the reversed input terminal and the output terminal of the first operational amplifier 621.

The non-reversed input terminal of the second operational amplifier 622 is connected to the output terminal of the first operational amplifier 621 through a resistance 622*a* and a capacitor 622*b* which are connected in series to one another. A resistance 622*c* is connected between the negative voltage terminal of the capacitor 616 and the connecting point of the resistance 622*a* and the capacitor 622*b*, while a diode 622*d* and resistances 622*e* and 622*f* are connected in series in this order between the output terminal of the second operational amplifier 622 and the negative voltage terminal of the capacitor 616. A resistance 622*g* is connected between the reversed input terminal of the second operational amplifier 622 and the connecting point of the diode 622*d* and the resistance 622*e*. Also, a capacitor 622*h* is connected in parallel to the resistance 622*f*.

A resistance 623*a* is connected between the non-reversed input terminal of the third operational amplifier 623 and the connecting point of the resistances 622*e* and 622*f*. The output terminal of the third operational amplifier 623 is connected to the base terminal of the transistor 624, while a resistance 623*b* is connected between the reversed input terminal of the third operational amplifier 623 and the emitter terminal of the transistor 624. The collector terminal of the transistor 624 is connected to the cathode terminal of the light emitting diode which functions as the display device 63. A resistance 623*c* is connected between the emitter terminal of the transistor 624 and the negative voltage terminal of the capacitor 616.

The anode terminal of the light emitting diode 51 is connected to the positive voltage terminal of the capacitor 616, while the cathode terminal of the light emitting diode 51 is connected to the collector terminal of the transistor 644. The anode terminal of the light emitting diode 63 is connected to the positive voltage terminal of the connector 611, while the cathode terminal of the light emitting diode 63 is connected to the collector terminal of the transistor 624.

The correction limit detection section 65 includes resistances 651, 652 and 654 and a switching transistor 653 (i.e., a transistor which switches from an OFF state to a fully ON condition very sharply). The resistors 651 and 652 are connected in series to one another between the emitter terminal of the transistor 644 and the negative voltage terminal of the capacitor 616. The connecting point of the resistances 651 and 652 is connected to the base terminal of the switching transistor 653. The emitter terminal of the switching transistor 653 is connected to the negative voltage terminal of the capacitor 616, and the collector terminal of the switching transistor 653 is connected to the cathode terminal of the light emitting diode 63 through the resistance 654.

The operation of the electric circuitry illustrated in FIG. 5 is as follows. In the stabilizing section 61, the first driving voltage for driving the light emitting diode 63 is maintained by the first zener diode 613, while the second driving voltage for driving the light emitting diode 51, the phototransistor 52 and the sensitivity correction section 64 is maintained by the second zener diode 615. When the window members 54 are not soiled at all, the second driving voltage is applied to the light emitting diode 51 and the phototransistor 52 so that the light emitting diode 51 radiates a light having a predetermined intensity based upon the collector current of the transistor 644 (when sensitivity correction has not been performed at all). A partial amount of light (the quantity of which is determined by the quantity of sucked dust) among the total amount of light radiated by the light emitting diode 51 is received by the phototransistor 52, so that the value of the collector current of the phototransistor 52 corresponds the quantity of sucked dust. As a result, the emitter voltage of the phototransistor 52 becomes a voltage which corresponds to the quantity of sucked dust.

The difference voltage between the emitter voltage of the phototransistor 52 and the standard voltage having the predetermined voltage value (which is determined based upon the resistance 641 and the diode 642) is amplified by the first, second and third operational amplifiers 621, 622 and 623 to control the conductance of the transistor 624. The intensity of the light emitted by the light emitting diode 63 is controlled based upon the conductance of the transistor 624, so that the quantity of sucked dust is visually displayed.

When soil adheres to the window members 54, the quantity of light received by the phototransistor 52 is decreased so that the collector current of the phototransistor 52 likewise is decreased and the emitter voltage of the phototransistor 52 is lowered. Since the emitter voltage of the phototransistor 52 is compared by the comparator 643 with the standard voltage having the predetermined voltage value, the output signal from the comparator 643 is increased, and the collector current of the transistor 644 is increased. Thus, the intensity of the light emitted by the light emitting diode 51 is increased. As a result, the decrease in the light quantity received by the phototransistor 52 due to soiling of the window members 54 is compensated for by the increase in the emitted light intensity of the light emitting diode 51, so that the quantity of sucked dust is accurately and visually displayed despite the adhering of soil to the window members 54.

Of course, when the quantity of soil which is adhered to the window members 54 is increased, the output signal from the comparator 643 is correspondingly increased so that the decrease in the light quantity received by of the phototransistor 52 due to soiling of the window members 54 is securely compensated for by an increase in the intensity of the light emitted by the light emitting diode 51.

The switching transistor 653 is in an OFF state until the collector current of the transistor 644 reaches a predetermined current value which is previously determined. When soiling of the window members 54 is increased so much that the collector current of the transistor 644 is increased to the predetermined current value, the switching transistor 653 turns sharply to its fully ON state so that the cathode terminal of the light emitting diode 63 is connected to ground (i.e. to the negative voltage terminal of the capacitor 616) through the resistance 654 and the switching transistor 653. When this occurs, the light emitting diode 63 radiates a light regardless of the existence or non-existence of a dust detection signal (that is, regardless of the output signal from the third operational amplifier 623 or the collector current of the transistor 624) from the signal processing section 62.

Thus, the vacuum cleaner user is informed that soiling of the window members 54 is increased so much that a correction (i.e. an increase) in the intensity of light emitted by the light emitting diode 51 by the sensitivity correction section 64 reaches its limit value. In this condition, the window members 54 are to be cleaned. Of course, the constant activation of the light emitting diode 63 also informs the vacuum cleaner user that the reliability in the display of the quantity of sucked dust is not high. However, even when the light emitting diode 63 is constantly activated, when dust is sucked through the hose 2, the transistor 624 conducts in correspondence to the quantity of sucked dust so that the light intensity of the light emitted by the light emitting diode 63 is increased, so that the vacuum cleaner user is still thereby visually informed that dust is being sucked by the vacuum cleaner.

Further, it is possible to employ an ordinary transistor instead of the switching transistor 653 (i.e., to employ a typical transistor which gradually has intermediate ON states between the fully OFF state and the fully ON state). In this case, the intensity of the light emitted from the light emitting diode 63 is gradually increased following an increase in soiling of the window members 54, so that the vacuum cleaner user is visually informed of the degree of soiling of the window members 54. However, with this alternate embodiment, the intensity of the light radiated from the light emitting diode 63 depends upon not only the quantity of sucked dust, but also upon the degree of soiling of the window members 54. Therefore, when a cleaning operation is carried out, it is impossible for the vacuum cleaner user to determine whether the intensity of the light emitted from the light emitting diode 63 depends upon the quantity of sucked dust or upon soiling of the window members 54 or what proportion of the light intensity is attributable to either condition. But, for example, when a cleaning operation is not performed, no dust is sucked at all so that the vacuum cleaner user can determine the degree of soiling of the window members 54 based upon the intensity of light emitted from the light emitting diode 63 at that time.

What is claimed is:

1. A vacuum cleaner comprising;

a vacuum cleaner body, a suction fan which is provided at a predetermined position of the vacuum cleaner body, suction passage means for sucking in air with dust, and for guiding the dust and the air to the vacuum cleaner body, a dust sensor of a light emitting and light receiving type which is provided at a predetermined position along the suction passage means, and has a dust detection sensitivity, sensitivity correction means for correcting the dust detection sensitivity of the dust sensor, and limit detection means for detecting a condition in which correction of the dust detection sensitivity by the sensitivity correction means reaches a limit value.

2. A vacuum cleaner as set forth in claim 1, wherein the dust sensor consists a light emitting device having a light emitting face and a light receiving device having a light receiving face, and further comprising a transparent window member for covering the light emitting face of the light emitting device and a transparent window member for covering the light receiving face of the light receiving device.

3. A vacuum cleaner as set forth in claim 2, further comprising information means for responding to detection of a limit condition by the limit detection means in which limit condition correction in the dust detection sensitivity by the sensitivity correction means reaches the limit value, and for informing a user of the limit condition in which correction of the dust detection sensitivity by the sensitivity correction means reaches the limit value.

4. A vacuum cleaner as set forth in claim 3, wherein the information means informs not only the limit condition in which correction in the dust detection sensitivity by the sensitivity correction means reaches the limit value, but also a quantity of dust detected by the dust sensor.

5. A vacuum cleaner as set forth in claim 4, wherein the limit detection means includes a resistance type potential dividing circuit which is connected in series to the light emitting device and a switching device which is controlled by a voltage obtained by the resistance type potential dividing circuit, and wherein the switching device is connected in series to the information means.

* * * * *